US007300197B2

(12) United States Patent
McCurdy et al.

(10) Patent No.: US 7,300,197 B2
(45) Date of Patent: Nov. 27, 2007

(54) APPARATUS FOR DISSOLVING A SOLID MATERIAL IN A LIQUID

(76) Inventors: Brent K. McCurdy, P.O. Box 32, Bryn Athyn, PA (US) 19009; Mario DeBerardinis, 347 Tom Brown Rd., Moorestown, NJ (US) 08057; David A. Johnson, 13355 Lafayette Way, Thornton, CO (US) 80241

( * ) Notice: Subject to any disclaimer, the term of this patent is extended or adjusted under 35 U.S.C. 154(b) by 0 days.

(21) Appl. No.: 11/510,672

(22) Filed: Aug. 28, 2006

(65) Prior Publication Data

US 2007/0047382 A1 Mar. 1, 2007

Related U.S. Application Data

(63) Continuation of application No. 10/780,719, filed on Feb. 19, 2004, now abandoned.

(51) Int. Cl.
*B01F 15/02* (2006.01)

(52) U.S. Cl. ..... 366/153.1; 366/143

(58) Field of Classification Search ..... 366/153.1, 366/151.1, 152.2, 160.1, 160.2, 162.1, 182.4; 137/268

See application file for complete search history.

(56) References Cited

U.S. PATENT DOCUMENTS 3,680,841 A * 8/1972 Yagi et al. ..... 366/118
4,653,568 A * 3/1987 Baldelli ..... 164/7.1
5,102,625 A * 4/1992 Milo ..... 422/82.07
5,400,137 A * 3/1995 Winslow et al. ..... 356/318
5,439,020 A * 8/1995 Lockhart ..... 137/3
5,678,593 A * 10/1997 Lockhart ..... 137/268
5,899,605 A * 5/1999 Caruthers et al. ..... 399/223
5,951,161 A * 9/1999 Blagg ..... 366/152.6
6,157,442 A * 12/2000 Raskas ..... 356/39
6,394,111 B1 * 5/2002 Jacobs et al. ..... 134/113
6,869,534 B2 * 3/2005 McDowell et al. ..... 210/620
2001/0033805 A1 * 10/2001 Jacobs et al. ..... 422/3
2005/0185505 A1 * 8/2005 McCurdy et al. ..... 366/153.1
2007/0047382 A1 * 3/2007 McCurdy et al. ..... 366/153.1

FOREIGN PATENT DOCUMENTS

JP 2005-43092 * 2/2005

* cited by examiner

*Primary Examiner*—Charles E. Cooley
(74) *Attorney, Agent, or Firm*—Stephen R. Greiner

(57) ABSTRACT

An apparatus for dissolving a solid material in a liquid including a container for receiving the solid material and the liquid. A turbidimeter measures the turbidity of the liquid in the container. A blender stirs the liquid in the container until the turbidity thereof, as measured by the turbidimeter, falls below a predetermined level. A sensor gauges the level of liquid in the container and causes a valve to admit liquid into the container when the liquid level falls below a set point.

9 Claims, 3 Drawing Sheets

APPARATUS FOR DISSOLVING A SOLID MATERIAL IN A LIQUID

This application is a continuation of U.S. patent application Ser. No. 10/780,719, filed on Feb. 19, 2004, now abandoned.

FIELD OF THE INVENTION

The present invention relates generally to means for dissolving a solid, flaky or pulverized material in a liquid, said means being energized in response to a measured optical property of the liquid.

BACKGROUND OF THE INVENTION

Detergents used in automated car washes typically include inorganic alkaline builders and organic surfactants. These detergents are typically delivered to car wash operators in concentrated liquid and powdered forms. Unfortunately, various problems associated with the organic and inorganic constituents of car wash detergents limit the concentration at which the detergents can be distributed and, ultimately, reduce profits.

Because of their instability, liquid detergents must be diluted with water and enhanced with stabilizers to prevent their breakdown during transit and storage. The disadvantages associated with increasing the amount of water in a detergent are many, with manufacturing, packaging, transporting, and handling costs rising in proportion to the amount of water added. Of course, highly concentrated liquid surfactants, absent the usual inorganic compounds, can be purchased, but they are less effective cleaners of land vehicles.

Detergents, delivered in powdered form, typically include a mix of finely divided phosphates, silicates and carbonates as well as a small amount of evenly distributed liquid surfactant. Generally, the surfactant concentration in the resulting detergent composition is limited to approximately 15 percent by weight. Excess amounts of the surfactant result in lumpy powders that will not flow through state of the art blending and dispensing equipment.

Dispensing a powdered detergent in a modern car wash is difficult. Hand measurement of the detergent by inexperienced workmen is time consuming and prone to mistake. Spraying an overly concentrated detergent onto a car is, of course, wasteful and can be harmful to the finish of the car. Further, prolonged and unchecked dampness can lead to consolidation of a powdered detergent into a solid, useless block.

In an effort to overcome some of these problems, Barton Lockhart of Corsicana, Tex., proposed an improved detergent mixing system in U.S. Pat. Nos. 5,439,020 and 5,678,593. Lockhart uses a tank for dissolving powdered, inorganic, detergent constituents in water until a saturated detergent base is formed. With a venturi, the saturated detergent base is drawn from the tank and mixed with a surfactant and other liquid detergent constituents to make a complete detergent liquid.

The use of Lockhart's system by car wash operators throughout the United States for about a decade has shown it to be practical and cost-effective, but problems have occasionally arisen for some operators. For example, undissolved inorganics in the detergent base sometimes flow from the mixing tank, blocking downstream flow. It has been found, however, that injecting a small amount of water into the flow line conveying the saturated detergent base from the mixing tank causes any undissolved material to dissolve and inhibits the growth of flow line-blocking crystals comprising dissolved inorganic material. Unfortunately, this injection of water makes it difficult to determine the exact concentration of saturated detergent base in the final detergent mix. Furthermore, water injection adds to the complexity of the system and can be a source of mistakes and confusion by operators of the system.

Lockhart's system also has the disadvantage of being affected by outside light sources such as overhead lights and solar light. These light sources affect the concentration of the detergent by registering to the mixer unit which is not capable of filtering out ambient light. Further, the float system used by Lockhart is a simple mechanical float which can at times become blocked by the build-up of contaminants or detergent powder. Further, the electronic basis of the current system uses mechanical relays which have a limited life span. Further, Lockhart's system uses a commercial light source (fluorescent bulb) which over a period of time changes the output of the bulb (as the light source ages the output changes) which affects the resulting readings. Further, the system requires an external standard (which simulates a turbid environment) to approximate the setting which is needed to achieve the desired results.

SUMMARY OF THE INVENTION

In light of the problems associated with the known systems for mixing liquid detergents, it is a principal object of the invention to provide an apparatus that is capable of dissolving as much of, or as little of, a quantity of a finely divided detergent constituent placed in a liquid as is desired. The apparatus functions automatically and with little monitoring by an operator.

It is another object of the invention to provide an apparatus of the type described that can continuously produce a liquid containing a predictable fixed concentration of a solute based on that solute's individual properties in exhibiting a unique turbidity profile when dissolved in a liquid over a range of concentrations, and despite the fact that the solute is never taken to a saturated level exhibiting high turbidity consistent with saturated levels of the solute.

It is another object of the invention to use a modulated light source and a receiver which is unique to that light source and which would not be affected by outside ambient light and therefore will yield a consistent and predictable solute concentration regardless of the placement of the system, whether it is inside in the dark, or outside in the sunlight, while at the same time providing a fixed, reliable light source that will be consistent over a long period of time (decades vs. 1 year).

It is also an object of the invention to provide an improved float mechanism that is non-mechanical, using a small electronic current from one point to another in the solution which will detect the level of the solution and signal the water valve to open and close. This improvement will avoid the problems associated with a mechanical float as previously mentioned.

It is an object of the invention to use electronic relays and low voltage systems, combined with a printed circuit board to expand the reliability and longevity of the system.

It is an object of the invention to introduce a system which relies on a fixed, reliable light source (an LED) which will be consistent over time and not require replacement.

It is an object of the invention to introduce a means for setting the system automatically using internally built adjustments against a standard solution, avoiding the use of an external turbidity simulation and adjusting for solute variations.

It is an object of the invention to provide improved features and arrangements thereof in an apparatus for the purposes described that is: lightweight in construction, inexpensive to manufacture, inexpensive to operate, and fully dependable in its output.

Briefly, the apparatus in accordance with this invention achieves the intended objects by featuring a container for receiving a finely divided, solid material and a liquid. A turbidimeter measures the turbidity of the liquid in the container as the liquid sits in contact with, and partially dissolves, the solid material. A controller is connected to the turbidimeter and selectively energizes a blender when the turbidity of the liquid in the container, as measured by the turbidimeter, drops below a predetermined level. The blender stirs the liquid in the container to hasten the dissolution of the solid material. An electronic level sensor gauges the level of liquid in the container and admits liquid into the container as the liquid is drawn off for use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
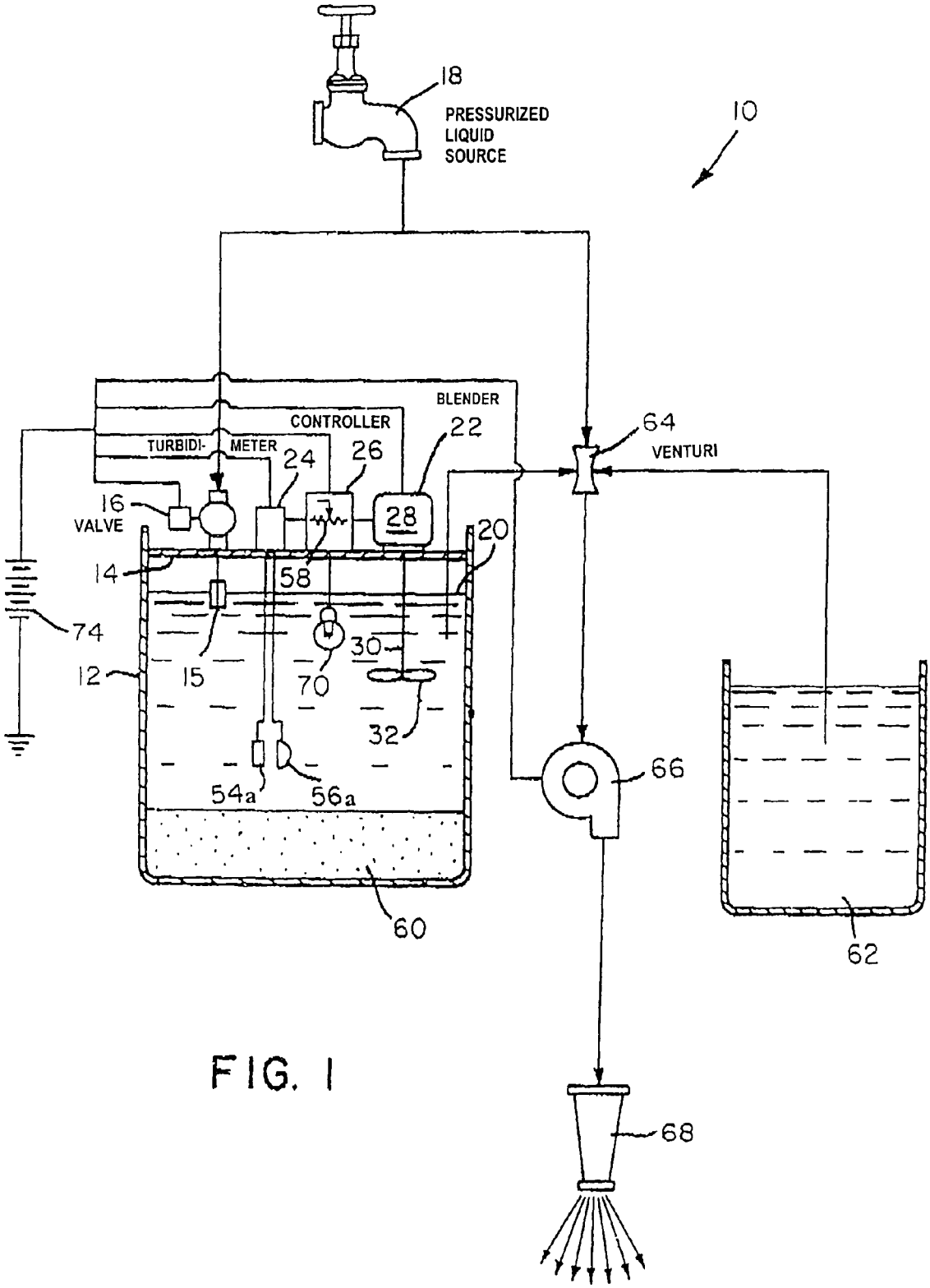
FIG. 1 is a schematic diagram of an apparatus, in accordance with the present invention, for dissolving a solid material in a liquid.
Figure 2:
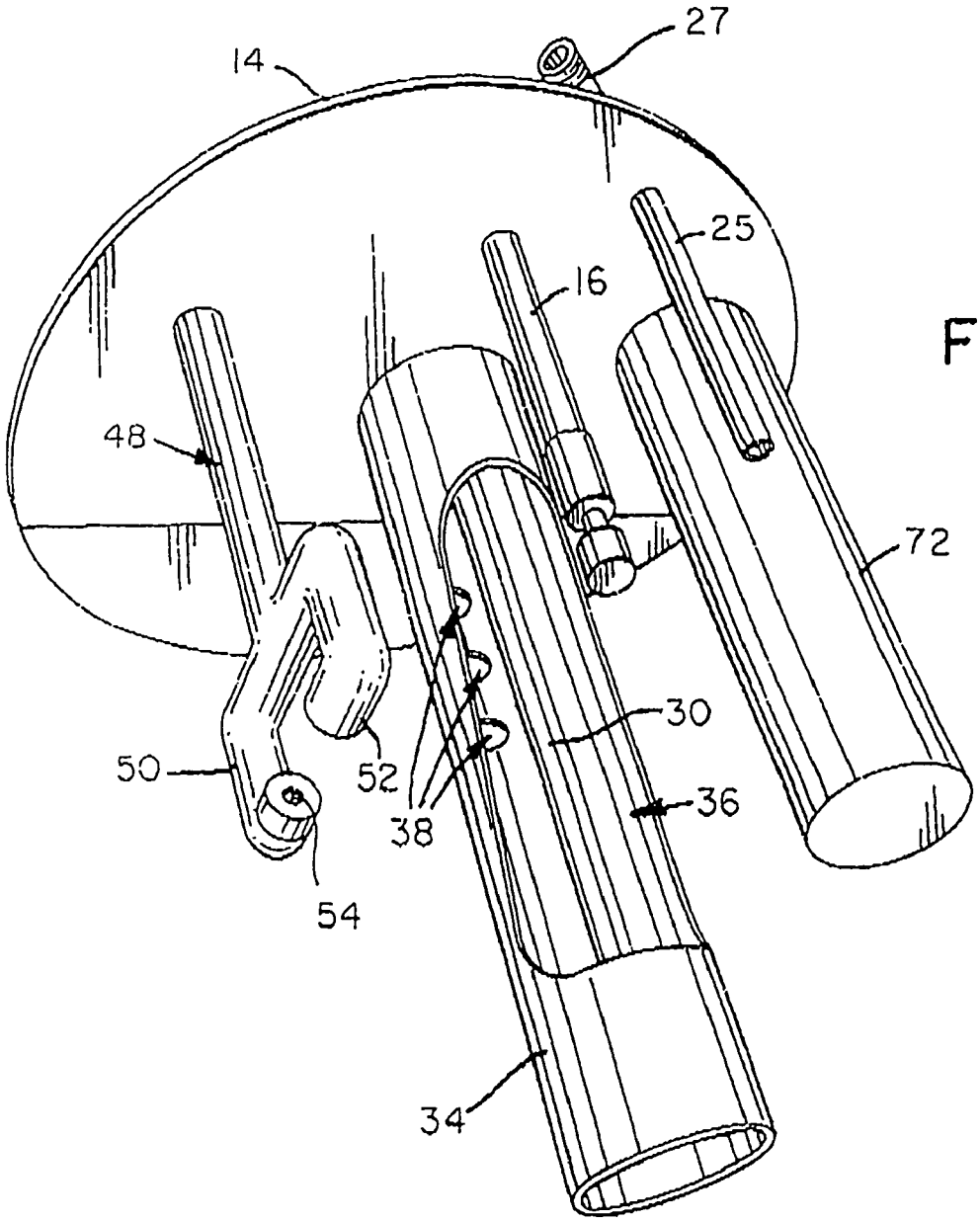
FIG. 2 is a perspective view of the container lid of the dissolving apparatus and the features appurtenant thereto.
Figure 3:
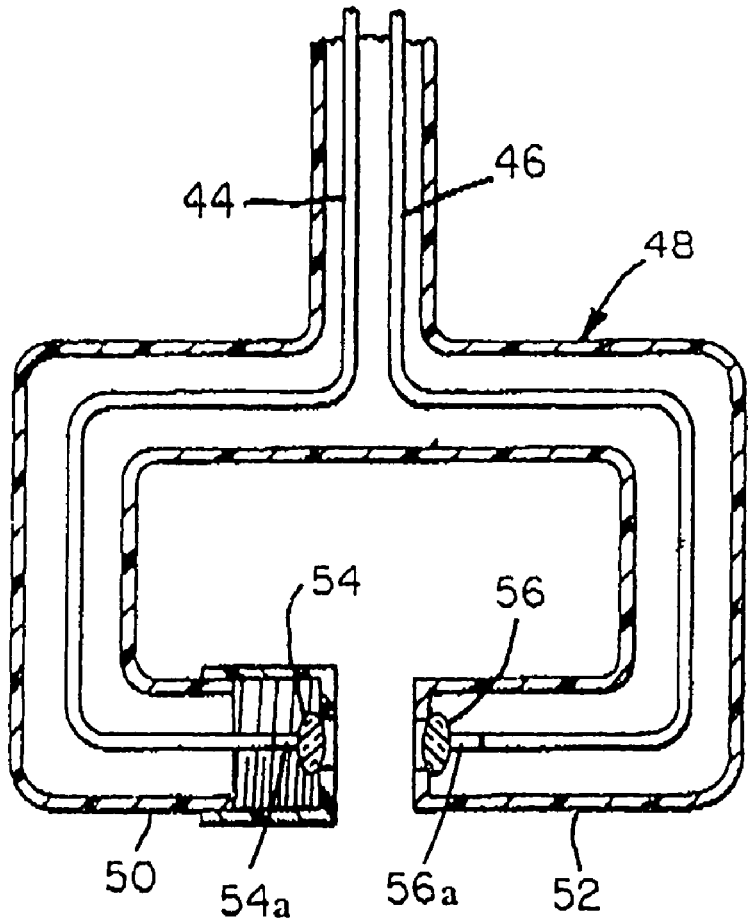
FIG. 3 is a cross-sectional view of the bottom of the fluid lance of the dissolving apparatus.

Referring now to the FIGS., an apparatus for dissolving a solid material in a liquid in accordance with the present invention is shown at 10. Apparatus 10 includes an open-topped container 12 upon which is positioned a hinged lid 14. On lid 14 is mounted a valve assembly including a solenoid-actuated valve 16 that permits liquid from a pressurized source 18 to enter container 12 when the level of liquid 20 therein drops below a predetermined minimum as gauged by an electronic liquid level sensor 15 connected to valve 16. A blender 22 is mounted upon lid 14 adjacent valve 16 for stirring liquid 20 in container 12. A turbidimeter 24 is mounted on lid 14 and connected to blender 22 via a controller 26 for energizing blender 22 when the turbidity of liquid 20 in container 12 falls below a predetermined threshold.

Blender 22 includes an electric motor 28 positioned atop lid 14. Motor 28 drives an elongated shaft 30 extending through lid 14 and into container 12. A propeller 32 is affixed to the bottom of shaft 30 for stirring liquid 20 in container 12 when motor 28 is energized.

A protective sleeve 34 is secured to the bottom of lid 14 and surrounds shaft 30 and propeller 32 to shield such whenever lid 14 is removed from container 12 for cleaning or servicing. Sleeve 34 is provided with a principal opening 36 in its front and a plurality of smaller, secondary openings 38 in its back. When propeller 32 is caused to rotate, liquid 20 is drawn into openings 36 and 38 and gently pushed from the bottom of sleeve 34 creating a minimally turbulent flow pattern in container 12.

Turbidimeter 24 comprises a light emitter **54*a* and a light receptor 56*a* coupled together electronically by wires 44 and 46 terminating at controller 26. Emitter 54*a* and receptor 56*a* are positioned in a lance 48 with a pair of tines 50 and 52 whose free ends are placed in opposition to one another. Emitter 54*a* and receptor 56*a* are housed in plastic lenses 54 and 56 to protect the emitter 54*a* and receptor 56*a* from the detergent solution. There is an electric signal that begins at controller 26 and flows to emitter 54*a* through wire 44 which sends a beam of light from lens 54 across the solution to lens 56 and is received into receptor 56*a*. This signal is received by receptor 56*a* and translated into an electronic signal which passes through wire 46 back to controller 26 and is used by controller 26** to make a mix/no mix decision based on turbidity.

Emitter **54*a* is a light emitting diode (LED) producing a modulated visible red light. LEDs are known for their toughness and great life expectancy, sometimes greater than 3-4 decades. Receptor 56*a* is a silicon phototransistor capable of filtering and receiving this specific LED light source from the emitter 54*a*. The phototransistor light receptor generates a pulsating current signal in response to the modulated light from the LED light source 54*a*. The light receptor 56*a*** current signal is converted to a voltage, using a transimpedence amplifier circuit. Additional signal processing circuits, filter the signal and ultimately produce a motor spin or no spin decision, based on the LED light signal strength detected.

Turbidimeter 24 can be adjusted to correct for anomalies in its construction and external conditions such as the usage of apparatus 10 with cloudy water. To this end, controller 26 contains electronics which can adjust the receptor signal from receptor 56 to re-calibrate the system to a standard solute turbidity. This calibration occurs via a multi turn variable resistor (not shown). Additionally, overall adjustments could be made by telescopically extending tines 50 to modify relative positions of lenses 54 and 56. Such a modification can be made to permit just enough light to pass between lenses 54 and 56 so that receptor **56*a* generates a predetermined output voltage for delivery to controller 26**. A fiber optic (not shown) light emitting phototransistor together with a transimpedence amplifier and receptor can be connected to fiber optic cables ending with lenses to accomplish a similar result as above.

Controller 26 is an electronic circuit that energizes motor 28 when the voltage received from receptor **56*a* increases above a predetermined threshold. In the preferred embodiment, however, controller 26 includes a variable resistor 58 connected to receptor 56*a*. By manually varying the resistance offered by resistor 58 to current flow, motor 28 can be energized when liquid 20 reaches practically any turbidity level. For example, it would not be unusual to set variable resistor 58 at a point where a 20% increase in the voltage normally received from receptor 56*a* (as might occur when clear water is admitted to container 12 through valve 16) energizes motor 28. The motor 28 remains energized until the turbidity of liquid 20, as reflected by the voltage output from receptor 56*a*, reaches its normal level by dissolving or suspending material positioned within container 12**.

Apparatus 10 is particularly well adapted to produce detergent liquids for use in car washes. To this end, predetermined turbidity measures of a given inorganic alkaline builder (a solute) are studied and mapped in terms of concentration and turbidity level. A desired turbidity and concentration level are arrived at for a given application. And these known proportions are used to form a powdery mixture 60 capable of dissolving in water. Then the alkaline builder mixture 60 is introduced into container 12 through lid 14. Next, water (a solvent) from source 18 is admitted into container 12 through valve 16, dissolving a portion of mixture 60 thereby turning liquid 20 into a detergent base. Emitter 54*a* and receptor 56*a* of turbidimeter 24 are exposed to liquid 20 in the container 12 so that controller 26, connected to receptor 56*a*, can convert the level of light received by receptor 56*a* into a measure of the desired turbidity of liquid 20 in container 12.

As long as the level of light received by the receptor 56*a* is greater than the predetermined threshold, liquid 20 in the container 12 is stirred by a propeller 32 rotated by motor 28 to dissolve the mixture 60. Once the turbidity of liquid 20 in container 12, as measured by the turbidimeter 24, passes above the predetermined level, the motor 28 is deenergized. The now-turbid liquid 20 is drawn from container 12 and combined with a remote source of surfactant 62 or other additive(s) necessary to complete the final detergent composition and a jetted stream of water from pressurized source 18 in a venturi 64 to form a complete detergent liquid. In cases where a venturi is not used and instead some other means of chemical injection and dilution is accomplished, typically via a chemical pump, the system would be adapted to use a manifold comprised of two or more hose barbs connected to a chamber within which the products combine and out of which via another hose barb they exit as one solution (not shown). This manifold would specifically combine the turbid liquid 20 with the surfactant 62 and the resulting combination would be injected into the wash process. The complete detergent liquid is pressurized by a pump 66 for delivery to a carwash spray nozzle 68.

Sensor 15 can either be a mechanical float 15 or preferably include an electronic float mechanism (not shown). The electronic float mechanism utilizes two metal probes which contact the turbid liquid 20 at the desired level of this solution. As long as the turbid liquid 20 touches both probes a small electronic current is able to pass between the probes. Should the turbid liquid 20 drop below these two probes, the current is cutoff and this results in a signal to the valve 16 to open and replenish the system with water until the electronic signal between the two probes is reestablished. Once a current between the probes is re-established the signal to the valve 16 stops and water ceases to enter the tank.

As liquid 20 is drawn from container 12 to venturi 64, the level of liquid 20 within the container 12 drops. Sensor 15 detects a drop and sends an electrical signal to valve 16 to which such is connected so as to open valve 16 and permit the flow of water from pressurized source 18 to enter into container 12 through hose 25 having a threaded fitting 27 at its top so as to restore the liquid level to its original condition. When sensor 15 determines that the level of liquid 20 has returned to its original position, the signal from sensor 15 to valve 16 is discontinued thereby closing valve 16.

A light bulb 70 is connected to controller 26 and suspended beneath lid 14 for observing the goings-on within container 12 and, especially, to help gauge the level of mixture 60 remaining in container 12. Bulb 70 is positioned within a watertight tube 72 secured to the bottom of lid 14. Tube 72 is formed from a translucent material so as to cast an even amount of light throughout container 12.

An electrical current source 74 powers: sensor 15, valve 16, blender 22, turbidimeter 24, controller 26, pump 66 and light bulb 70. Electrical current source 74 may, by way of example, be an electrical current grid or storage battery.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

We claim:

1. An apparatus for dissolving a solid material in a liquid, said apparatus comprising:

a container for receiving the solid material and the liquid;

a turbidimeter for measuring the turbidity of the liquid in said container, said turbidimeter including:

a fluid lance extending into said container, said fluid lance having a pair of tines with free ends placed in opposition to one another, said fluid lance also having a pair of lenses in said free ends permitting light to pass through said free ends;

a light emitter being positioned within one of said tines for producing light for passage through the adjacent one of said lenses and into said container; and, a light receptor being positioned in the other one of said tines and being connected to said controller for receiving light from said light emitter and producing a voltage signal in proportion to the amount of light detected;

a blender for stirring the liquid in said container;

a controller being connected to said light turbidimeter for selectively energizing said blender when the voltage signal received from said light receptor drops below a predetermined level; and, a valve assembly for gauging the level of liquid in said container and admitting liquid into said container when the liquid level falls from a set level.

2. The apparatus according to claim 1 further comprising a light source for illuminating the interior of said container so that the quantity of solid material received therein can be visually gauged.

3. The apparatus according to claim 1 wherein said light emitter is an LED producing a modulated visible red light.

4. The apparatus according to claim 3 wherein said light receptor is a phototransistor adapted to detect the light from said LED.

5. The apparatus according to claim 1 further comprising:

a pump having an inlet being connected to said container and an outlet, said pump being adapted to draw liquid, and any solid material dissolved in the liquid, from said container into said inlet and discharge such from said outlet;

a pressurized source of water being connected in parallel with said container to said inlet of said pump; and, a spray nozzle for receiving the discharge from said outlet of said pump and releasing the discharge into the atmosphere as a fine mist.

6. An apparatus for dissolving a solid material in a liquid, said apparatus comprising:

an open-topped container for receiving the solid material and the liquid;

a lid atop said container;

a turbidimeter secured to said lid for measuring the turbidity of the liquid in said container;

a blender secured to said lid for stirring the liquid in said container until the turbidity thereof, as measured by said turbidimeter, reaches a predetermined level; and, a valve assembly secured to said lid for gauging the level of liquid in said container and admitting liquid into said container when the liquid level falls.

7. The apparatus according to claim 6 further comprising a light source suspended from said lid for illuminating the interior of said container.

8. The apparatus according to claim 6 wherein said turbidimeter further includes:

a fluid lance extending downwardly from said lid, said fluid lance having a pair of tines with free ends being placed in opposition to one another;

a light emitter being positioned within one of said tines for emitting light into said container; and, a light receptor being positioned in the other one of said tines and being connected to said blender for receiving light from said light emitter and for energizing said blender when the amount of light received from said light emitter is within a predetermined range.

9. The apparatus according to claim 8 further comprising:

a pump for drawing liquid, and any solid material dissolved in the liquid, from said container;

a pressurized source of water being connected in parallel with said container to said pump; and, a spray nozzle for receiving the discharge from said pump and releasing such into the atmosphere as a fine mist.

* * * * *